US008516838B1

(12) United States Patent
Papagna

(10) Patent No.: US 8,516,838 B1
(45) Date of Patent: Aug. 27, 2013

(54) REFRIGERATION SYSTEM AND ASSOCIATED METHOD

(76) Inventor: Anthony Papagna, Fleming Island, FL (US)

( * ) Notice: Subject to any disclaimer, the term of this patent is extended or adjusted under 35 U.S.C. 154(b) by 380 days.

(21) Appl. No.: 13/030,915

(22) Filed: Feb. 18, 2011

Related U.S. Application Data

(60) Provisional application No. 61/306,089, filed on Feb. 19, 2010.

(51) Int. Cl.
*F25B 41/00* (2006.01)

(52) U.S. Cl.
USPC ..... 62/113; 62/175; 62/335; 62/510

(58) Field of Classification Search
USPC ..... 62/79, 113, 175, 185, 335, 434, 436, 62/498, 513
See application file for complete search history.

(56) References Cited

U.S. PATENT DOCUMENTS

| | | | | | |
|---|---|---|---|---|---|
| 4,142,374 | A | | 3/1979 | Ansted et al. | |
| 4,993,233 | A | | 2/1991 | Borton et al. | |
| 5,687,579 | A | * | 11/1997 | Vaynberg | 62/175 |
| 5,743,102 | A | | 4/1998 | Thomas et al. | |
| 5,894,739 | A | * | 4/1999 | Temos | 62/436 |
| 6,094,925 | A | * | 8/2000 | Arshansky et al. | 62/81 |
| 6,257,007 | B1 | | 7/2001 | Hartman | |
| 6,276,152 | B1 | * | 8/2001 | Sibik | 62/201 |
| 6,405,554 | B1 | * | 6/2002 | Kawakatu et al. | 62/335 |
| 6,460,355 | B1 | * | 10/2002 | Trieskey | 62/175 |
| 6,532,754 | B2 | * | 3/2003 | Haley et al. | 62/129 |
| 6,557,361 | B1 | * | 5/2003 | Howard | 62/175 |
| 6,606,872 | B1 | * | 8/2003 | Smith | 62/175 |
| 6,640,561 | B2 | * | 11/2003 | Roberto | 62/96 |
| 6,666,042 | B1 | | 12/2003 | Cline et al. | |
| 6,981,385 | B2 | * | 1/2006 | Arshansky et al. | 62/155 |
| 7,603,874 | B2 | * | 10/2009 | Fink et al. | 62/434 |
| 7,823,413 | B2 | * | 11/2010 | Beving et al. | 62/468 |
| 2004/0134218 | A1 | | 7/2004 | Alexandre | |

* cited by examiner

*Primary Examiner* — Mohammad M Ali

(57) ABSTRACT

An improved refrigeration system may include a first refrigeration loop or one to multiple units of split chillers providing cooling for HVAC, dehumidification, medium temperature load cases and further condensing the refrigerant utilizing a heat exchanger for the cascadable low temperature units. The system may be scalable and the distributive design utilizes chillers to replace the traditional rack system. The first refrigeration loop may incorporate an integral or remote pump(s) which provides coolant through conduits to the medium temperature cases, HVAC and low temperature heat exchangers. The system may further include a combined direct expansion condenser and free cooler system incorporating a partial, pre-chiller through the combination direct expansion, water, fluid (secondary) coolant condenser. This may allow for the water or fluids systems to be cooled by the ambient temperature and fans reducing the compressor run time or even allowing the compressors to turn off.

13 Claims, 4 Drawing Sheets

REFRIGERATION SYSTEM AND ASSOCIATED METHOD

CROSS REFERENCE TO RELATED APPLICATIONS

This application claims the benefit of U.S. Provisional Application No. 61/306,089, filed Feb. 19, 2010, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to refrigeration systems and, more particularly, to an improved refrigeration system for providing users with an easy and convenient means of providing cooling to a building HVAC as well as to a multiple of low, medium and high chiller load cases.

2. Prior Art

Chillers remove heat from a liquid via a vapor-compression or absorption refrigeration cycle. A vapor-compression water chiller comprises the 4 major components of the vapor-compression refrigeration cycle (compressor, evaporator, condenser, and some form of metering device). These machines can implement a variety of refrigerants. Absorption chillers use municipal water as the refrigerant and benign silica gel as the desiccant. Absorption chillers utilize water as the refrigerant and rely on the strong affinity between the water and a lithium bromide solution to achieve a refrigeration effect.

Most often, pure water is chilled, but this water may also contain a percentage of glycol and/or corrosion inhibitors; other fluids such as thin oils can be chilled as well. In air conditioning systems, chilled water is typically distributed to heat exchangers, or coils, in air handling units, or other type of terminal devices which cool the air in its respective space(s), and then the chilled water is re-circulated back to the chiller to be cooled again. These cooling coils transfer sensible heat and latent heat from the air to the chilled water, thus cooling and usually dehumidifying the air stream. A typical chiller for air conditioning applications is rated between 15 to 1500 tons (180,000 to 18,000,000 BTU/h or 53 to 5,300 kW) in cooling capacity. Chilled water temperatures can range from 35 to 45 degrees Fahrenheit or 1.5 to 7 degrees Celsius, depending upon application requirements.

The chillers for industrial applications can be centralized, where each chiller serves multiple cooling needs, or decentralized where each application or machine has its own chiller. It is also possible to have a combination of both central and decentralized chillers, especially if the cooling requirements are the same for some applications or points of use, but not all. Each approach has its advantages but are individually designed and installed thus they are not efficient. In addition, none of these chiller systems are capable of providing both HVAC and chiller room cooling with a complete building approach to reduce installation and maintenance costs, save space and energy and allow a scalable configuration in case of building space and chiller rooms expansion.

Accordingly, a need remains for a system in order to overcome the above-noted shortcomings. The present invention satisfies such a need by providing an improved refrigeration system that is convenient and easy to use, lightweight yet durable in design, versatile in its applications, and designed for providing cooling to a building HVAC as well as to a multiple of low, medium and high chiller load cases.

BRIEF SUMMARY OF THE INVENTION

In view of the foregoing background, it is therefore an object of the present invention to provide a refrigeration system provides cooling to an existing building HVAC and chiller load cases. These and other objects, features, and advantages of the invention are provided by a refrigeration system including a chiller containing a refrigerant, a plurality of medium temperature fixtures communicatively coupled to the chiller, and a plurality of cascaded low temperature compressor units communicatively coupled to the medium temperature fixtures and located downstream from the chiller. Such cascaded lower temperature compressor units may have a first heat exchanger respectively. Advantageously, the refrigerant circulates through a closed looped containing the chiller and the medium temperature fixtures and the cascaded lower temperature compressor units. In this manner, the refrigerant is condensed to a liquid secondary coolant after passing through the first heat exchanger and prior to returning to the chiller.

In a non-limiting exemplary embodiment, the chiller preferably includes a first compressor, a second heat exchanger in fluid communication with the first compressor, and a thermostatic expansion valve communicatively coupled the second heat exchanger and located upstream thereof. The chiller may further include a first pump communicatively coupled to the second heat exchanger and located upstream thereof, first supply and return fluid pipes intermediately connected between the second heat exchanger and the cascaded low temperature compressor units, and an HVAC communicatively coupled to the second heat exchanger and located upstream thereof. In this manner, the first pump circulates the liquid secondary coolant through the medium temperature fixtures, the HVAC and the first heat exchangers via the first supply and return pipes.

In a non-limiting exemplary embodiment, a combination direct expansion and fluid cooler system may be located outdoors and in fluid communication with the first compressor and the second heat exchanger. Notably, the combination direct expansion and fluid cooler system pre-cools the liquid secondary coolant via cold outdoor ambient temperatures and thereby reduces an operating time of the first compressor.

In a non-limiting exemplary embodiment, the combination direct expansion and fluid cooler system is situated exterior of the chiller.

In a non-limiting exemplary embodiment, the combination direct expansion and fluid cooler system is situated within the chiller.

In a non-limiting exemplary embodiment, at least one of the cascaded low temperature compressor units are cascaded directly through the chiller wherein the cascaded low temperature compressor units may be in fluid communication with the first supply and return pipes respectively.

In a non-limiting exemplary embodiment, each of the cascaded low temperature single compressor units preferably includes a second compressor connected to the first heat exchanger.

In a non-limiting exemplary embodiment, second and third return fluid pipes may be communicatively coupled to the first heat exchanger and located upstream and downstream thereof respectively. In this manner, the third return fluid pipe introduces warm fluid to the first return fluid pipe after the warm fluid passes through the first heat exchanger and prior to returning to the chiller respectively. Notably, the warm fluid preferably mixes with the liquid secondary coolant prior to returning to the chiller.

In a non-limiting exemplary embodiment, a second pump may be located at one of the cascaded low temperature compressor units and thereby regulates fluid flow through the first heat exchanger such that a head pressure of the cascaded low temperature compressor unit is regulated by operating and non-operating modes of the second pump.

In a non-limiting exemplary embodiment, a second supply line is located upstream of the first pump, wherein the first pump is automatically activated when the ambient temperature falls below a minimum threshold level and thereby diverts a portion of the fluid secondary coolant from the first return line to the second supply line. In this manner, the second supply line is in fluid communication with the combination direct expansion and fluid cooler system such that the liquid secondary coolant is cooled by a cool outer ambient temperature prior to reaching the combination direct expansion and fluid cooler system.

In a non-limiting exemplary embodiment, a heat exchanger blower assembly may be in fluid communication with the combination direct expansion and fluid cooler system for providing spot cooling to the liquid secondary coolant.

In a non-limiting exemplary embodiment, a method of utilizing a refrigeration system may provide cooling to an existing building HVAC and chiller load cases. Such a method preferably includes the chronological steps of: providing a chiller containing a refrigerant; partially located the chiller indoors; providing and communicatively coupling a plurality of medium temperature fixtures to the chiller; providing and communicatively coupling a plurality of cascaded low temperature compressor units to the medium temperature fixtures; locating the cascaded low temperature compressor units downstream from the chiller wherein each of the cascaded lower temperature compressor units have a first heat exchanger respectively; circulating the refrigerant through a closed looped containing the chiller and the medium temperature fixtures and the cascaded lower temperature compressor units; and condensing the refrigerant to a liquid secondary coolant after passing through the first heat exchanger and prior to returning to the chiller.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

Figure 1:
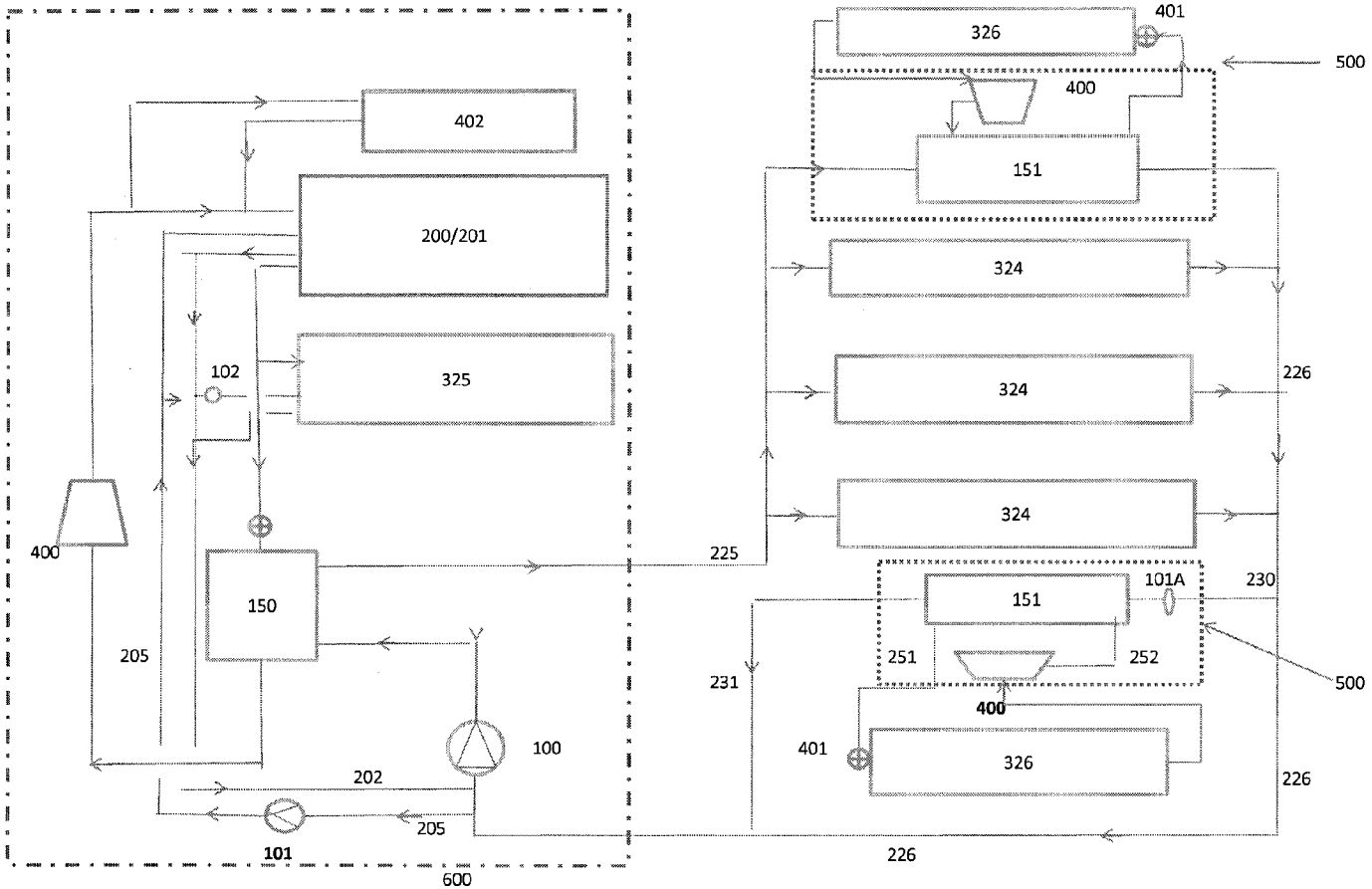
FIG. 1 is a high-level schematic block diagram showing the combined direct expansion condenser and fluid cooler system located within the chiller, in accordance with an embodiment of the present invention.

Those skilled in the art will appreciate that the figures are not intended to be drawn to any particular scale; nor are the figures intended to illustrate every embodiment of the invention. The invention is not limited to the exemplary embodiments depicted in the figures or the shapes, relative sizes or proportions shown in the figures.

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

One or more embodiments of the disclosure may be referred to herein, individually and/or collectively, by the term "present invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 C.F.R. §1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The below disclosed subject matter is to be considered illustrative, and not restrictive, and the appended claims are intended to cover all such modifications, enhancements, and other embodiments which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The system of this invention is referred to generally in FIGS. 1-4 and is intended to provide an improved refrigeration system. It should be understood that the present invention may be used to cool an entire building's HVAC and a multiple of chillers and many other different types of refrigeration cases, and should not be limited to the uses described herein.

In a non-limiting exemplary embodiment of the present invention, the chiller 600 is scalable and the distributive fluid/secondary coolant design utilizes chillers to replace the traditional (conventional) direct expansion rack system, which eliminates the need for a mechanical room or dedicated area. It can be a complete building approach where (one to multiple units) that can provide cooling or spot HVAC, 325 dehumidification, as an option. The chiller 600 preferably provides fluid (secondary) coolant to medium temperature 324 fixtures and or refrigerated cases, walk-ins and also condenses the refrigerant to liquid through the heat exchanger 151 for the (cascade) low temperature compressor units 500.

In a non-limiting exemplary embodiment of the present invention, the system reduces the cost of the building and increases the back room area for stocking. As perhaps best shown in FIGS. 1 and 4, the package 600 or split 601 chiller may incorporate a compressor(s) 400; a heat exchanger 150 and thermostatic expansion valve 401; integral or remote pump(s) 100 which provide(s) water/fluid secondary coolant through conduits of pipe 225 & 226 to high, medium 324 temperature cases, coolers, HVAC 325 and low temperature condensers 151.

Figure 2:
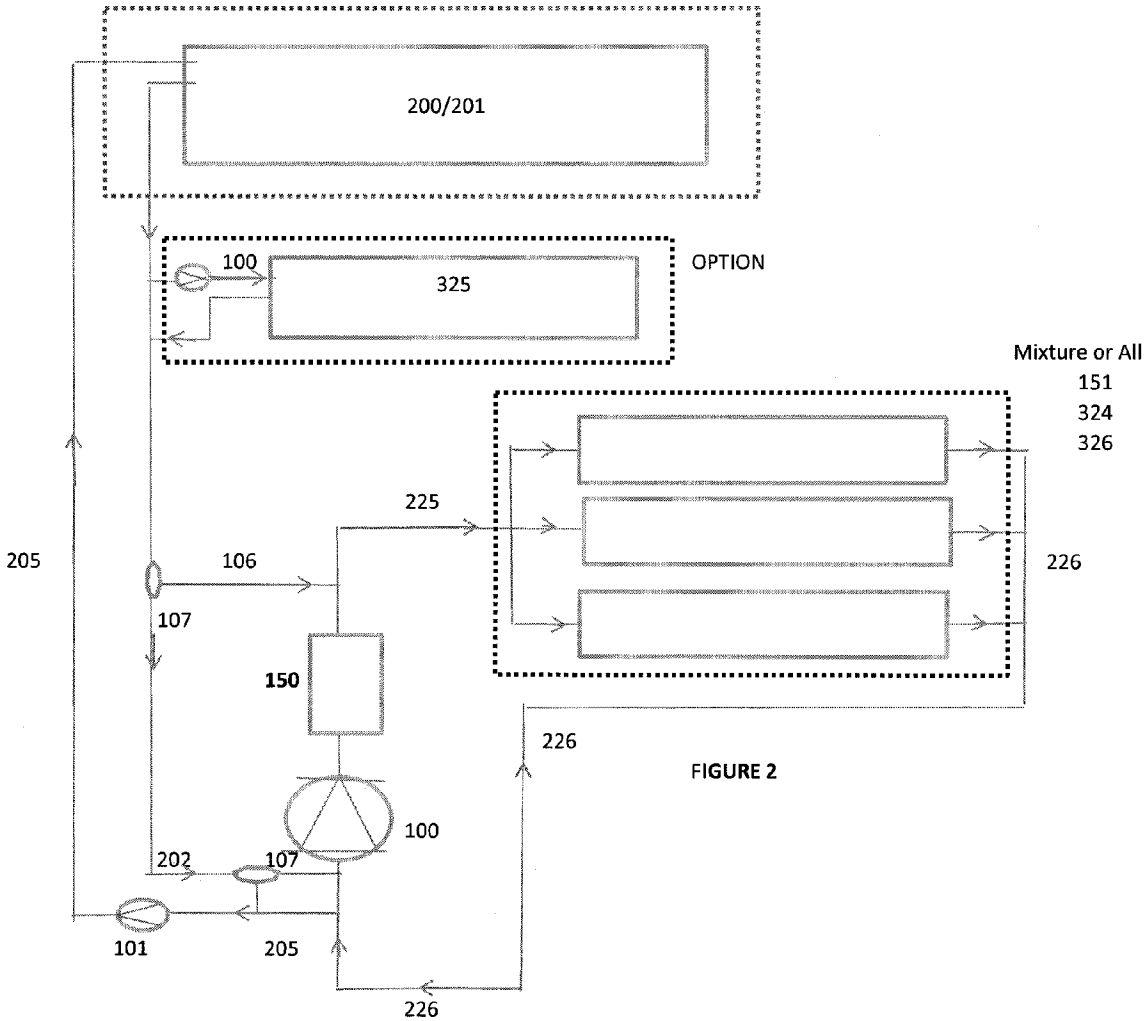
FIG. 2 is a high level schematic block diagram showing the interrelationship between the major components of the present invention for sending the fluid secondary coolant via the outside by pipe 205 to the combination water/fluid portion of the condenser 200/201 to be cooled by the outdoors, when the ambient temperature falls below a minimum Fahrenheit threshold level, in accordance with an embodiment of the present invention.
Figure 3:
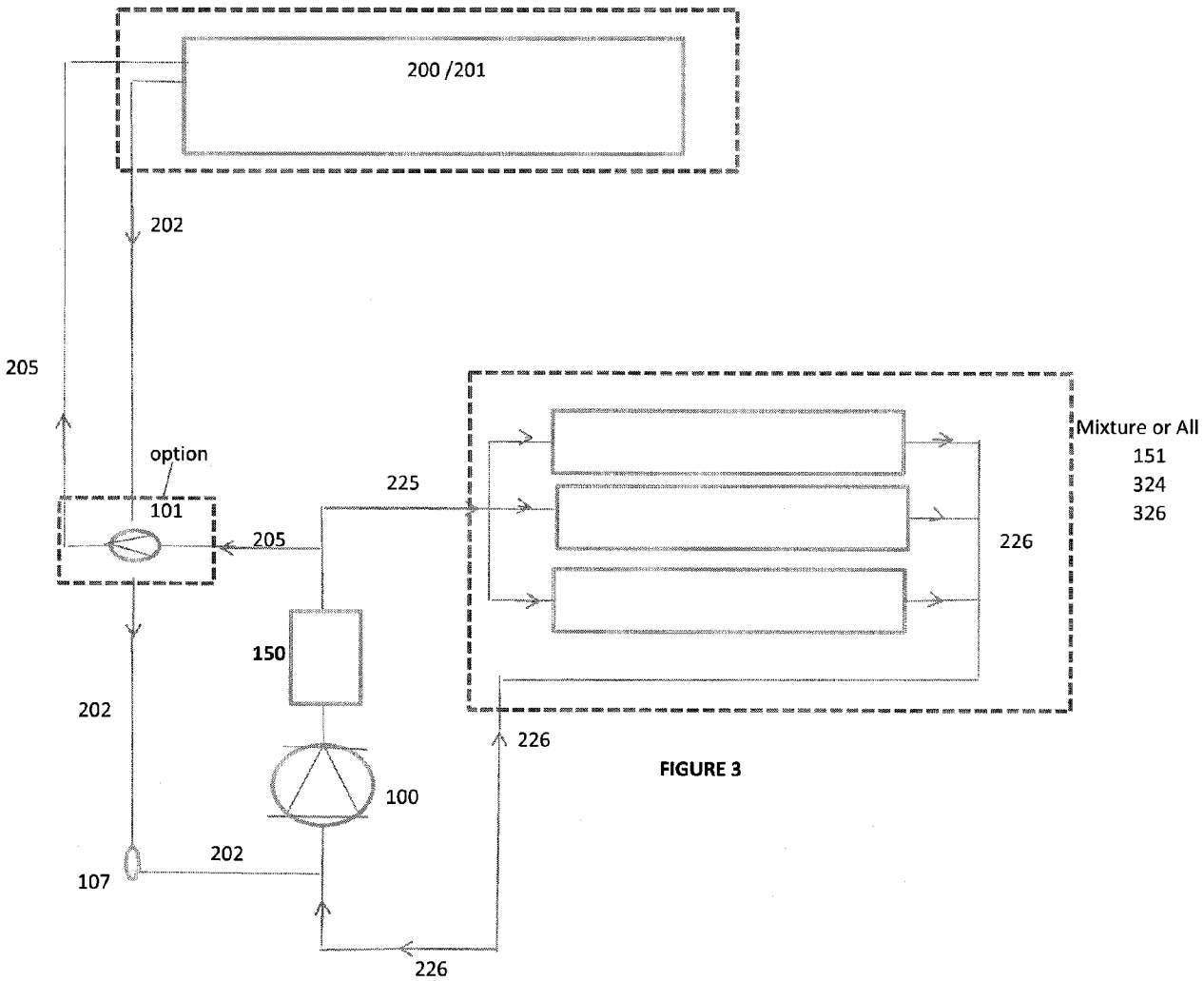
FIG. 3 is high-level schematic block diagram showing the main heat exchanger branch circuit 205 upstream of the heat exchanger 150 and pump(s) 101 used as an option, in accordance with an embodiment of the present invention.

In a non-limiting exemplary embodiment of the present invention, as perhaps best shown in FIGS. 2 and 3, the system may also incorporate a combination direct expansion and fluid cooler system 200/201 that can be designed for various stages (example 10%, 15%, 25%, 50%, 100%, etc) in order to accommodate ambient temperature. There are many significant benefits and advantages associated with the combined direct expansion condenser and fluid cooler system 200/201. As an example, the system 200/201 may take advantage of outdoor cold ambient conditions to allow the ambient temperatures to pre-chill, partial or cool the water fluid (secondary coolant) thereby naturally reducing compressor run time and/or keeping compressors 400 from cycling on. Both free cooling & direct expansion may run simultaneously in order to maintain proper or critical temperatures thereby eliminating the need of a separate heat exchanger and separate fluid coolers.

In a non-limiting exemplary embodiment of the present invention, the system allows several low temperature unit(s) to be cascaded 151 directly through the chiller system 600. The system will allow all year (40 to 60 degree Fahrenheit) low condensing temperatures thereby eliminating the need of sub-coolers. This reduces the required connected compressor horsepower thus increasing energy efficiency of low temperature compressors over standard air cooled systems.

In a non-limiting exemplary embodiment of the present invention, low temperature units 500 may be direct expansion systems designed with various refrigerants including $CO_2$, wherein one or multiple units can operate multiple or single of load(s). The system can be applied to a wide application such as pharmaceutical, blood banks, industrial warehouses, mini blast freezers, supermarkets, c-stores, with a wide operating temperatures range of 0° to −45 degrees Fahrenheit.

In a non-limiting exemplary embodiment of the present invention, distributed systems 500 can refrigerate 1 but typically 2 or more loads sized. For refrigerants less than 50 pounds, they may be compact (low profile) that can be located outdoor, in a back stock area, and/or near or on top of the low temperature fixtures. The low temperature single compressor units 500 preferably include a compressor 400 and heat exchanger 326. Control panels may include, but not limited to, defrost. Electrical connections and contactors can be designed so that 1 to 4 can be place on a common base frame but electrically can be single point connections.

In a non-limiting exemplary embodiment of the present invention, unit 500 can be designed with or without receiver, controls, valves, etc. The system design offers significant safeties compared to the traditional (conventional) low temperature rack systems where as the low temperature cases with a portion of heat exchanger 326 are shown as one load, but can be multiple loads broken up on various packaged or spilt chillers 600/601. This system may reduce product liability because pipe 251 & 252 are connected to the compressor 400 and supply various refrigerants to the cases and metering devices 401 supplied by the equipment manufacturer.

In a non-limiting exemplary embodiment of the present invention, a feature of the system is to utilize either supply fluid 225 or return fluid 230 to condense the low temperature 151 condensing unit(s). This allows a warmer temperature to be utilized if necessary for the low temperature condensing units. The fluid returns through pipe 231 and thereby mixes with other return water or fluid (secondary) pipes 226.

In a non-limiting exemplary embodiment of the present invention, pump(s) 101A on unit 500 can include a VFD (variable frequency drive) to regulate the flow through the heat exchanger thereby regulating head pressure of the compressor. This feature is very important when the loads change the temperature change from −50 degrees Fahrenheit to +35 degrees Fahrenheit. The pump 101A eliminates the need for mixing valves, actuators, etc. in order to maintain proper compression ratios set by a compressor manufacturer, for example.

Referring to FIG. 2, in a non-limiting exemplary embodiment of the present invention, when the ambient temperature falls below X degrees Fahrenheit, (typically below 35 degrees Fahrenheit) the control activates pump(s) 101, which can incorporate variable speed pump, diverts a portion of fluid (secondary coolant) from return line 226 to supply line 205. The fluid/secondary coolant is sent to the outside by pipe 205 to the combination water/fluid portion of the condenser 200/201 to be cooled by the outdoors.

In a non-limiting exemplary embodiment of the present invention, once cooled by outdoor temperatures, the fluid or secondary coolant returns through pipe 202 to be mixed with fluid in return line 226 prior to entering heat exchanger 150 for final cooling. Utilizing the outdoor temperature to cool the fluid or secondary coolant reduces energy required by main compressors 400 for cooling water or secondary coolant fluid.

In a non-limiting exemplary embodiment of the present invention, the water, fluid and secondary coolant is then sent to the refrigeration load (cases) 151 and 324 through pipe 225 and returned back to the main chiller through pipe 226 where the cycle starts over.

In a non-limiting exemplary embodiment of the present invention, a safety feature of the present system provides the water, fluid and secondary coolant 106 or coolant to bypass the main chiller if the water or fluid is too cold. This is accomplished through solenoid controls 107, mixing, check valves, actuators, etc. If the water or fluid (secondary) is not (X) temperature, it returns through pipes and conduits 202 which it can bypass back to 205 or return 226 for final cooling.

In a non-limiting exemplary embodiment of the present invention, a option of the systems that can also provide an integral or remote heat exchanger blower assembly 325 in order to provide spot cooling, sub-cooling or direct cooling to loads (high, medium, & low temperature condensers) when required. Pipes 205A, when required, may utilize pump(s) 103 to transfer fluid or secondary coolant to the load.

FIG. 3 illustrates a similar concept as FIG. 2 taken after the heat exchanger branch circuit 205 of the heat exchanger 150 and pump(s) 101 used as an option.

Figure 4:
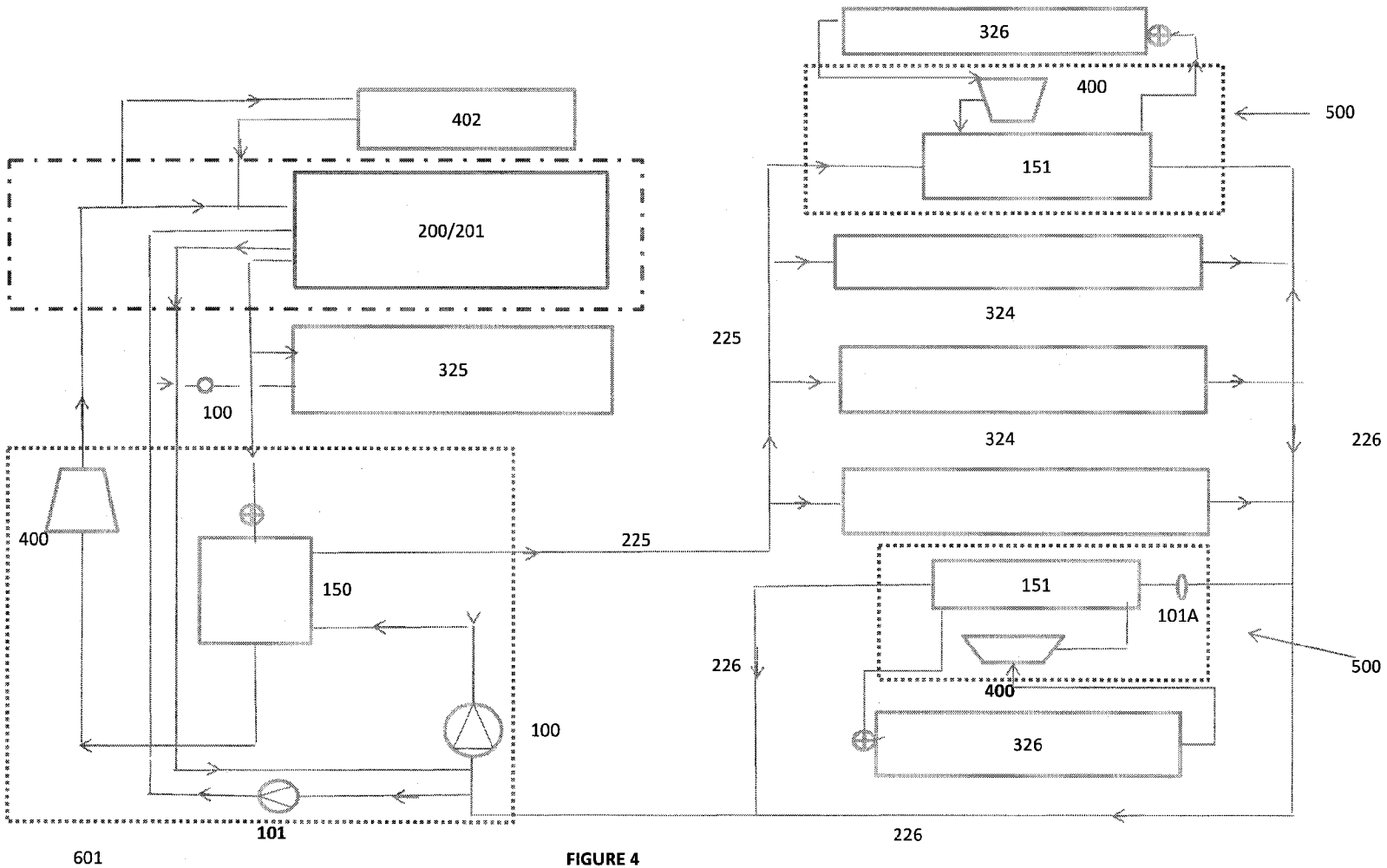
FIG. 4 is a high-level schematic block diagram showing the combined direct expansion condenser and fluid cooler system located exterior of the chiller, in accordance with an embodiment of the present invention.

FIG. 4 illustrates a similar concept as FIG. 1 with the exception of employing split system compressor unit 601 installed indoors and condenser 200/201 located outdoors.

In a non-limiting exemplary embodiment of the present invention, thermostatic expansion valves 401 may be used to change high pressure liquid to low pressure liquid, as perhaps best shown in FIGS. 1 and 4.

The benefits of the present system and conventional free cooling systems is the ability to incorporate several low temperature fixtures such as condenser(s) 151 on a chiller 600 and take advantage when outdoor temperatures fall below 30 degrees Fahrenheit to provide free cooling for refrigeration. Various embodiments of the present system take advantage of outdoor cold ambient conditions to allow the outdoor ambient temperatures to pre-chill, partial or cooling of water. Such pre-chilled fluid (secondary coolant) naturally reduces compressors run time and/or keeps compressors from cycling on. Both the present system and the direct expansion system disclosed in U.S. patent application Ser. No. 12/938,978 may simultaneously run to maintain proper and/or critical temperatures thereby eliminating the need of a separate heat exchanger and separate fluid coolers, for example. The added heat exchanger incorporates sub-cooling of the direct expansion refrigerant systems when required whereas conventional free cooling circuits are typically maintained via HVAC temperatures and not refrigeration.

Various embodiments of the present invention provide advantages to medium temperature systems. Such advantages may include: reduced refrigerant charge; pumps incorporated in packaged designs; ABS® plastic piping for reducing copper piping & material costs; ABS® and quick connect for case to case piping; quick connect repair kit for ABS® plastic piping; ease of startup thereby reducing commission time; use of compression fittings thereby allowing quick connection; reduced installation cost (less piping and fittings); reduced amount of control valves (TXVs and EPRs); reduced maintenance cost; and distributive design.

Various embodiments of the present invention provide advantages to low temperature systems. Such advantages may include: reduced compressor horsepower (−45%); lower operating condensing temperatures 40 to 50 degrees Fahrenheit; not requirement of oil safety controls; constant and lower liquid temperatures all year long; constant and stable head pressures all year long; low compression ratio (4.24); temperature range of 0 to −45 degrees Fahrenheit; reduced refrigerant charge or less than 50 pounds; reduced line sizing requirements; reduced TXV (thermostatic expansion valve) sizing; reduced heat on compressor motors and oil; reduced maintenance cost; and elimination of liquid sub-cooling.

In a non-limiting exemplary embodiment, a refrigeration system provides cooling to an existing building HVAC and chiller load cases. Such a refrigeration system preferably includes a chiller 600 containing a refrigerant, a plurality of medium temperature fixtures 324 communicatively coupled to the chiller, and a plurality of cascaded low temperature compressor units 500 communicatively coupled to the medium temperature fixtures and located downstream from the chiller. Each of the cascaded lower temperature compressor units preferably has a first heat exchanger 151 respectively. Advantageously, the refrigerant circulates through a closed looped containing the chiller and the medium temperature fixtures and the cascaded lower temperature compressor units. In this manner, the refrigerant is condensed to a liquid secondary coolant after passing through the first heat exchanger and prior to returning to the chiller.

In a non-limiting exemplary embodiment, the chiller 600 may include a first compressor 400, a second heat exchanger 150 in fluid communication with the first compressor, and a thermostatic expansion valve 401 communicatively coupled the second heat exchanger and located upstream thereof. The chiller 600 may also include a first pump 100 communicatively coupled to the second heat exchanger and located upstream thereof, first supply and return fluid pipes intermediately connected between the second heat exchanger and the cascaded low temperature compressor units, and an HVAC communicatively coupled to the second heat exchanger and located upstream thereof. Notably, the first pump circulates the liquid secondary coolant through the medium temperature fixtures, the HVAC and the first heat exchangers 151 via the first supply and return pipes.

In a non-limiting exemplary embodiment, a combination direct expansion and fluid cooler system may be located outdoors and remains in fluid communication with the first compressor and the second heat exchanger. Advantageously, the combination direct expansion and fluid cooler system pre-cools the liquid secondary coolant via cold outdoor ambient temperatures and thereby reduces an operating time of the first compressor.

In a non-limiting exemplary embodiment, the combination direct expansion and fluid cooler system may be situated exterior of the chiller.

In a non-limiting exemplary embodiment, the combination direct expansion and fluid cooler system may be situated within the chiller.

In a non-limiting exemplary embodiment, at least one of the cascaded low temperature compressor units may be cascaded directly through the chiller and thereby remains in fluid communication with the first supply and return pipes respectively.

In a non-limiting exemplary embodiment, each of the cascaded low temperature single compressor units may include second compressor connected to the first heat exchanger.

In a non-limiting exemplary embodiment, second and third return fluid pipes communicatively may be coupled to the first heat exchanger and located upstream and downstream thereof respectively. Such a third return fluid pipe preferably introduces warm fluid to the first return fluid pipe after the warm fluid passes through the first heat exchanger and prior to returning to the chiller respectively. In this manner, the warm fluid mixes with the liquid secondary coolant prior to returning to the chiller and thereby advantageously provides added protection to the heat exchanger 150. If the liquid second coolant (glycol) falls below the freeze point the glycol can form ice crystals or freeze, which is undesirable.

In a non-limiting exemplary embodiment, a second pump may be located at one of the cascaded low temperature compressor units and thereby regulates fluid flow through the first heat exchanger such that a head pressure of the cascaded low temperature compressor unit is regulated by operating and non-operating modes of the second pump.

In a non-limiting exemplary embodiment, a second supply line may be located upstream of the first pump. Notably, the first pump may be automatically activated when the ambient temperature falls below a minimum threshold level and thereby diverts a portion of the fluid secondary coolant from the first return line 226 to the second supply line 205. The second supply line may be in fluid communication with the combination direct expansion and fluid cooler system such that the liquid secondary coolant is cooled by cool outer ambient temperature prior to reaching the combination direct expansion and fluid cooler system.

In a non-limiting exemplary embodiment, a heat exchanger blower assembly 325 may be fluid communication with the combination direct expansion and fluid cooler system for providing spot cooling to the liquid secondary coolant.

In a non-limiting exemplary embodiment, a method of utilizing a refrigeration system may provide cooling to an existing building HVAC and chiller load cases. Such a method preferably comprises the chronological steps of: providing a chiller 600 containing a refrigerant; partially located the chiller indoors; providing and communicatively coupling a plurality of medium temperature fixtures 324 to the chiller; providing and communicatively coupling a plurality of cascaded low temperature compressor units 500 to the medium temperature fixtures; locating the cascaded low temperature compressor units 500 downstream from the chiller wherein each of the cascaded lower temperature compressor units have a first heat exchanger 151 respectively; circulating the refrigerant through a closed looped containing the chiller and the medium temperature fixtures and the cascaded lower temperature compressor units; and condensing the refrigerant to a liquid secondary coolant after passing through the first heat exchanger and prior to returning to the chiller.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention. In particular, with respect to the above description, it is to be realized that the optimum dimensional relationships for the parts of the present invention may include variations in size, materials, shape, form, function and manner of operation.

What is claimed as new and what is desired to secure by Letters Patent of the United States is:

1. A refrigeration system for providing cooling to an existing building HVAC and chiller load cases, said refrigeration system comprising:

a chiller containing a refrigerant;

a plurality of medium temperature fixtures communicatively coupled to said chiller; and a plurality of cascaded low temperature compressor units communicatively coupled to said medium temperature fixtures and located downstream from said chiller, each of said cascaded lower temperature compressor units having a first heat exchanger respectively;

wherein the refrigerant circulates through a closed looped containing said chiller and said medium temperature fixtures and said cascaded lower temperature compressor units;

wherein the refrigerant is condensed to a liquid secondary coolant after passing through said first heat exchanger and prior to returning to said chiller.

2. The refrigeration system of claim 1, wherein said chiller comprises:

a first compressor;

a second heat exchanger in fluid communication with said first compressor; and a thermostatic expansion valve communicatively coupled said second heat exchanger and located upstream thereof;

a first pump communicatively coupled to said second heat exchanger and located upstream thereof;

first supply and return fluid pipes intermediately connected between said second heat exchanger and said cascaded low temperature compressor units; and an HVAC communicatively coupled to said second heat exchanger and located upstream thereof;

wherein said first pump circulates the liquid secondary coolant through said medium temperature fixtures, said HVAC and said first heat exchangers via said first supply and return pipes.

3. The refrigeration system of claim 2, further comprising:

a combination direct expansion and fluid cooler system located outdoors and in fluid communication with said first compressor and said second heat exchanger;

wherein said combination direct expansion and fluid cooler system pre-cools said liquid secondary coolant via cold outdoor ambient temperatures and thereby reduces an operating time of said first compressor.

4. The refrigeration system of claim 3, wherein said combination direct expansion and fluid cooler system is situated exterior of said chiller.

5. The refrigeration system of claim 3, wherein said combination direct expansion and fluid cooler system is situated within said chiller.

6. The refrigeration system of claim 3, wherein at least one of said cascaded low temperature compressor units are cascaded directly through said chiller, said cascaded low temperature compressor units being in fluid communication with said first supply and return pipes respectively.

7. The refrigeration system of claim 3, wherein each of said cascaded low temperature single compressor units comprises: a second compressor connected to said first heat exchanger.

8. The refrigeration system of claim 1, further comprising:

second and third return fluid pipes communicatively coupled to said first heat exchanger and located upstream and downstream thereof respectively, said third return fluid pipe introducing warm fluid to said first return fluid pipe after the warm fluid passes through said first heat exchanger and prior to returning to said chiller respectively;

wherein said warm fluid mixes with said liquid secondary coolant prior to returning to said chiller.

9. The refrigeration system of claim 8, further comprising:

a second pump at one of said cascaded low temperature compressor units and thereby regulating fluid flow through said first heat exchanger such that a head pressure of said one cascaded low temperature compressor unit is regulated by operating and non-operating modes of said second pump.

10. The refrigeration system of claim 8, further comprising: a second supply line located upstream of said first pump, wherein said first pump is automatically activated when the ambient temperature falls below a minimum threshold level and thereby diverts a portion of said fluid secondary coolant from said first return line to said second supply line;

wherein said second supply line is in fluid communication with said combination direct expansion and fluid cooler system such that said liquid secondary coolant is cooled by cool outer ambient temperature prior to reaching said combination direct expansion and fluid cooler system.

11. The refrigeration system of claim 1, further comprising: a heat exchanger blower assembly in fluid communication with said combination direct expansion and fluid cooler system for providing spot cooling to said liquid secondary coolant.

12. A refrigeration system for providing cooling to an existing building HVAC and chiller load cases, said refrigeration system comprising:

a chiller containing a refrigerant and adapted to be partially located indoors;

a plurality of medium temperature fixtures communicatively coupled to said chiller; and a plurality of cascaded low temperature compressor units communicatively coupled to said medium temperature fixtures and located downstream from said chiller, each of said cascaded lower temperature compressor units having a first heat exchanger respectively;

wherein the refrigerant circulates through a closed looped containing said chiller and said medium temperature fixtures and said cascaded lower temperature compressor units;

wherein the refrigerant is condensed to a liquid secondary coolant after passing through said first heat exchanger and prior to returning to said chiller.

13. A method of utilizing a refrigeration system for providing cooling to an existing building HVAC and chiller load cases, said method comprising the chronological steps of:

providing a chiller containing a refrigerant;

partially located said chiller indoors;

providing and communicatively coupling a plurality of medium temperature fixtures to said chiller;

providing and communicatively coupling a plurality of cascaded low temperature compressor units to said medium temperature fixtures;

locating said cascaded low temperature compressor units downstream from said chiller wherein each of said cascaded lower temperature compressor units have a first heat exchanger respectively;

circulating the refrigerant through a closed looped containing said chiller and said medium temperature fixtures and said cascaded lower temperature compressor units; and condensing the refrigerant to a liquid secondary coolant after passing through said first heat exchanger and prior to returning to said chiller.

* * * * *